US008348717B2

(12) United States Patent
Silva et al.

(10) Patent No.: US 8,348,717 B2
(45) Date of Patent: Jan. 8, 2013

(54) POLISHING WHEEL

(75) Inventors: Marc Silva, Roanoke, VA (US); James Daniel Riall, Flagstaff, AZ (US); Jean-Marc Padiou, Champigny sur Marne (FR); Loïc Quere, La Varenne Saint Hilaire (FR)

(73) Assignee: Essilor International (compagnie Generale d'optique), Charenton le Pont (FR)

( * ) Notice: Subject to any disclaimer, the term of this patent is extended or adjusted under 35 U.S.C. 154(b) by 968 days.

(21) Appl. No.: 11/722,113

(22) PCT Filed: Dec. 21, 2005

(86) PCT No.: PCT/EP2005/014214

§ 371 (c)(1),
(2), (4) Date: May 21, 2008

(87) PCT Pub. No.: WO2006/066976

PCT Pub. Date: Jun. 29, 2006

(65) Prior Publication Data

US 2009/0088055 A1 Apr. 2, 2009

Related U.S. Application Data

(60) Provisional application No. 60/638,078, filed on Dec. 21, 2004.

(51) Int. Cl.
*B24B 13/00* (2006.01)

(52) U.S. Cl. ..... 451/5; 451/42; 451/541

(58) Field of Classification Search ..... 451/42, 451/541, 548, 5
See application file for complete search history.

(56) References Cited

U.S. PATENT DOCUMENTS

| | | | | |
|---|---|---|---|---|
| 4,958,463 | A * | 9/1990 | Hess et al. | 451/178 |
| 4,989,316 | A * | 2/1991 | Logan et al. | 29/527.3 |
| 5,895,311 | A * | 4/1999 | Shiotani et al. | 451/5 |
| 6,162,117 | A | 12/2000 | Vo | |
| 6,471,733 | B1 * | 10/2002 | Cooper | 51/298 |
| 6,602,110 | B2 * | 8/2003 | Yi et al. | 451/9 |
| 6,953,381 | B2 * | 10/2005 | Siders et al. | 451/5 |
| 7,503,834 | B2 * | 3/2009 | Kuebler et al. | 451/42 |
| 2004/0229553 | A1 | 11/2004 | Bechtold et al. | |

FOREIGN PATENT DOCUMENTS

| | | |
|---|---|---|
| JP | S47-004188 | 1/1971 |
| JP | H05-503468 | 6/1993 |
| JP | 3013408 | 7/1995 |
| JP | 2001-138196 | 5/2001 |

* cited by examiner

*Primary Examiner* — Robert Rose
(74) *Attorney, Agent, or Firm* — Occhiuti Rohlicek & Tsao LLP

(57) ABSTRACT

A polishing wheel (10) arranged to polish an article. The polishing wheel comprises a hub (12) provided with an axial cavity (18) coaxial with an axis (26). The polishing wheel further comprises a substrate layer (14) being made of an elastomer material affixed to the hub (12) and coaxial with the axis (26). The substrate layer (14) has an outer surface (20) having a substantially symmetrical shape with respect to the axis (26). The polishing wheel (10) further comprises a continuous cover layer (16) affixed to the outer surface (20) and coaxial with the axis (26). The continuous cover layer (16) is made of an elastomer material covering substantially entirely the outer surface (20).

20 Claims, 6 Drawing Sheets

POLISHING WHEEL

CROSS-REFERENCE TO RELATED APPLICATIONS

This application is being filed as a U.S. National Stage under 35 U.S.C. 371 of International Application No. PCT/EP2005/014214, filed on Dec. 21, 2005, which claims the benefit of U.S. application Ser. No. 60/638,078, filed Dec. 21, 2004. The contents of both applications are hereby incorporated by reference in their entirety.

FIELD OF INVENTION

This invention relates to a polishing wheel arranged to polish an article, and more particularly an optical article, for example, an optical lens. This invention also relates to a method of manufacturing a polishing wheel, a method for polishing an article, and a computer program product for polishing an article.

The article according to the invention may be made of, for example, glass, plastic or metal, such as, for example, a mould. The article of the invention includes any optical article for either concentrating or diverging light. Said optical article may be part of an optical system such as, for example, a telescope, a microscope or a camera.

BACKGROUND OF INVENTION

Optical lenses are used in ophthalmic devices such as eyeglasses and contact lenses and in precision instruments such as cameras, telescopes, microscopes, and range finders. These lenses are typically made by imparting a specific curvature on a first side of a transparent material such as mineral glass or plastic, and a different curvature on the opposite side of the material. By creating a curve on the second side of the lens that is different than the curve on the first side of the lens, light can be focused to a desired point.

The process of producing a lens generally begins by first grinding or otherwise machining a glass or plastic blank to achieve the approximate curvature or curvatures desired. The grinding process creates surface roughness on the surface of the lens, which tends to undesirably scatter light passing to or from the lens. To reduce this surface roughness, the lens is polished to obtain a smoother surface. In addition, polishing can provide a more precise curvature to the lens surface allowing the light exiting the lens to be more accurately focused.

Blanks used for eyeglasses typically are made by injection molding or casting a thermosetting polymer such as diethylene glycol bis(allyl carbonate) (CR-39) or polycarbonate. These blanks typically measure between 70 and 80 mm in diameter and between 8 and 20 mm in thickness. The blank may also include a base curve that is close to the desired power of the lens. Once a blank with a base curve is formed, its back is ground to make a lens of the desired power (e.g. to match the eyeglasses prescription).

Most automated grinding machines have a cutter that is held stationary while rotating the lens and moving it along two axes with respect to the cutter. If the lens requires a curvature in addition to simple spherical and/or cylindrical cuts, the lens can be ground while tilted to produce an offset optical center (i.e. an induced prism). After the lens is ground, it is sanded and then polished. Polishing machines typically utilize a lap, which is an abrasive pad attached to a block having a matching, but reversed, curvature of the lens. The lap and lens are rubbed together to remove the surface roughness left by the grinding process and to make any final corrections to the curvature of the lens. This polishing method has the disadvantage of requiring a separate lap for each lens prescription. Thus, a typical lens processing facility will have hundreds if not thousands of different laps available to produce eyeglasses conforming to a wide range of prescription requirements.

More advanced polishing machines have recently been developed that utilize a pivoting head which carries a tool spindle to which a shaping tool, such as a polishing wheel, is attached. With respect to the lens, the rotating polishing wheel moves along a first horizontal axis (the "X-axis") having a left-right orientation and along a second horizontal axis (the "Y-axis") having a front-rear orientation. In addition, the spindle upon which the wheel is mounted moves vertically along a "Z-axis". The spindle also moves in a circular direction about a "C-axis". These advanced polishing machines typically utilizing a positional feed-back system to control the movement of the wheel.

Polishing wheels have a fine abrasive surface that can reduce the surface roughness of a lens when the abrasive surface contacts and moves across the surface of the lens. The surface of the wheel is typically curved in order to follow the curved contour of the lens surface. Thus, polishing wheels typically are of a cylindrical or spherical shape.

Generally, these polishing wheels have an axis and corresponding axial cavity for receiving a rotatable motor-driven spindle. The contact surface of the wheel is symmetrical with respect to this axis in order to allow for continuous contact between the wheel and lens while the wheel or lens is rotating about an axis.

Conventional polishing wheels typically have a urethane skin that is cut from a flat sheet and glued onto a spherical natural rubber substrate that surrounds a spherical aluminum hub. The flat sheet is cut in such a way as to allow it to be folded to conform to the spherical shape of the substrate. However, this folding technique invariably results in a discontinuous surface and gaps in the skin tend to form at the junctions of the folds. These gaps are partially responsible for the limited life of the polishing tool because they can catch on the edge of the lens during the polishing process and begin to tear away from the rubber substrate. Over time, the outer skin can also begin to crack at the intersection of the gaps.

The urethane skins known in the art are also difficult to replace once they become worn. Removing a worn urethane skin from the rubber substrate and replacing it with a new one requires the use of toxic chemicals. The rubber substrate of known wheels also suffer the tendency of pulling away from their respective aluminum hub. In addition, it is often difficult to produce and maintain a rubber substrate and outer urethane shell that is concentric with the aluminum hub. Polishing wheels with substrates, outer shells, or both that are not concentric to the hub can impart low frequency waves onto the surface of the lens during the polishing process which, in turn, reduces the accuracy of the polishing operation.

DESCRIPTION OF THE INVENTION

This invention was conceived to avoid the drawbacks of the above-cited prior art, and relates to a polishing wheel arranged to polish an article, this polishing wheel comprising:

- a hub provided with an axial cavity coaxial with an axis; preferably, the hub has a spherical outer surface approximately symmetrical to the axial cavity;
- a substrate layer being made of an elastomer material affixed to the hub and coaxial with the axis, the substrate layer having an outer surface, the outer surface having a substantially symmetrical shape with respect to the axis; and a continuous cover layer affixed to the outer surface and coaxial with the axis, the continuous cover layer being made of an elastomer material covering substantially entirely the outer surface.

The continuous cover layer may be any continuous layer having elastomer properties which covers substantially entirely the outer surface 20 of the substrate layer 14. The continuous cover layer may be made, for example, of natural rubber, synthetic rubber, silicon material or any combination thereof. It has to be understood that the continuous cover layer 16 does not necessarily comprise abrasive elements such as polishing grains. There are many alternatives. The abrasive elements can be included both in the polishing liquid and in the continuous cover layer, in the continuous cover layer 16 only or in the polishing liquid only. Advantageously the hardness of the continuous abrasive layer 16 is higher than the hardness of the substrate layer.

Preferably, the continuous cover layer is made from a urethane binder. In a preferred embodiment of the invention, the continuous cover layer has a substantially uniform thickness. According to an embodiment of the invention, the hardness of the continuous cover layer is bigger than the hardness of the substrate layer. Preferably, the substrate layer may be made from any composition having elastomer properties comprising, for example, natural rubber, synthetic rubber, silicon material or any combination thereof. More preferably, the substrate layer is made from a polyurethane material.

According to an embodiment of the invention, the continuous cover layer comprises polishing grains. Preferably, the polishing grains are abrasive. More preferably, the polishing grains are selected from the group consisting of diamonds, cesium oxide, silicon carbide, aluminum oxide, boron carbide, cubic boric nitrite, emery, zirconium oxide, cerium oxide, and garnet.

The outer surface 20 may have a spherical, torical, or cylindrical shape, and more generally any symmetrical or substantially symmetrical shape with respect to the axis 26. In a preferred embodiment, the outer surface (20) is spherical.

In a preferred embodiment, the polishing wheel comprises a hub provided with an axial cavity coaxial with an axis, a substrate layer being made of an elastomer material affixed to the hub and coaxial with the axis, the substrate layer having an outer surface, the outer surface having a substantially symmetrical shape with respect to the axis.

The invention also relates to a method of manufacturing a polishing wheel arranged to polish an article, the polishing wheel comprising a hub (12) provided with an axial cavity (18) coaxial with an axis (26), a substrate layer (14) being made of an elastomer material affixed to the hub (12) and coaxial with the axis (26), the substrate layer (14) having an outer surface (20), the outer surface (20) having a substantially symmetrical shape with respect to the axis (26), wherein the method comprises a covering step, in which the outer surface (20) of the substrate layer is covered with an elastomer material so as to obtain a continuous cover layer (16) covering substantially entirely the outer surface (20).

The covering step may imply any suitable covering techniques known by the skilled artisan to cover substantially entirely the outer surface with an elastomer material in a continuous manner. In a first embodiment, the covering step is realized by using coating techniques such as, for example, dip coating or spraying. In a second embodiment, the covering step is realized by using molding techniques.

Advantageously, the covering step is followed by a curing step, in which the elastomer material is cured.

In an embodiment of the invention, the substrate layer is affixed to the hub by using such covering techniques, preferably by using molding techniques. Advantageously, once affixed to the hub, the outer surface of the substrate layer is machined so to obtain a substantially symmetrical shape with respect to the axis.

The invention also relates to a method of polishing an article, the method comprising the steps of:

(a) providing an article comprising a first side having a surface roughness;

(b) providing a polishing wheel as described hereabove;

(c) rotating.

(d) contacting the first side of the article with the polishing wheel to reduce the surface roughness.

In an embodiment of the invention, in the rotating step, the article and the polishing wheel are rotating with respect to each other by using a rotating element. The rotating element may be a shaft. The polishing wheel may be provided with a hub 12 arranged to receive said shaft.

In another embodiment, the rotating element may also be the article itself. In a further embodiment, the rotating element may be both the article and the polishing wheel. The article can be, for example, an optical article in particular an optical lens. The article can also be a mould made from glass or metal.

In an embodiment of the invention, the method is such that an area of the first side has an approximate parabolic or spherical curvature and the method further comprises the step of:

(e) contacting the area of the first side with the polishing wheel to remove a portion of the article to produce a truer parabolic or spherical curvature.

According to an embodiment of the method, the article is a lens, and the first side comprises a first curvature having a first diopter $D_1$ and a second curvature having a second diopter $D_2$, wherein $D_1 \neq D_2$.

According to an embodiment of the method, the contacting step comprises controlling the polishing wheel along an X-axis, Y-axis, Z-axis, and C-axis.

In a preferred embodiment of the invention, the polishing wheel is controlled by a computer numerical controlled device.

Preferably, the article is a lens made from glass or plastic.

The invention also relates to a computer program pct for a data processing device, the computer program product comprising a set of instructions which, when loaded into the data processing device, causes the device to perform at least one of the steps of the method hereabove described.

BRIEF DESCRIPTION OF THE DRAWINGS

The accompanying drawings, which are incorporated in and constitute a part of the specification, illustrate a presently preferred embodiment of the invention. Together with the general description given above and the detailed description of the preferred embodiments given below, they serve to explain the principles of the invention.

DETAILED DESCRIPTION OF THE INVENTION

Figure 1:
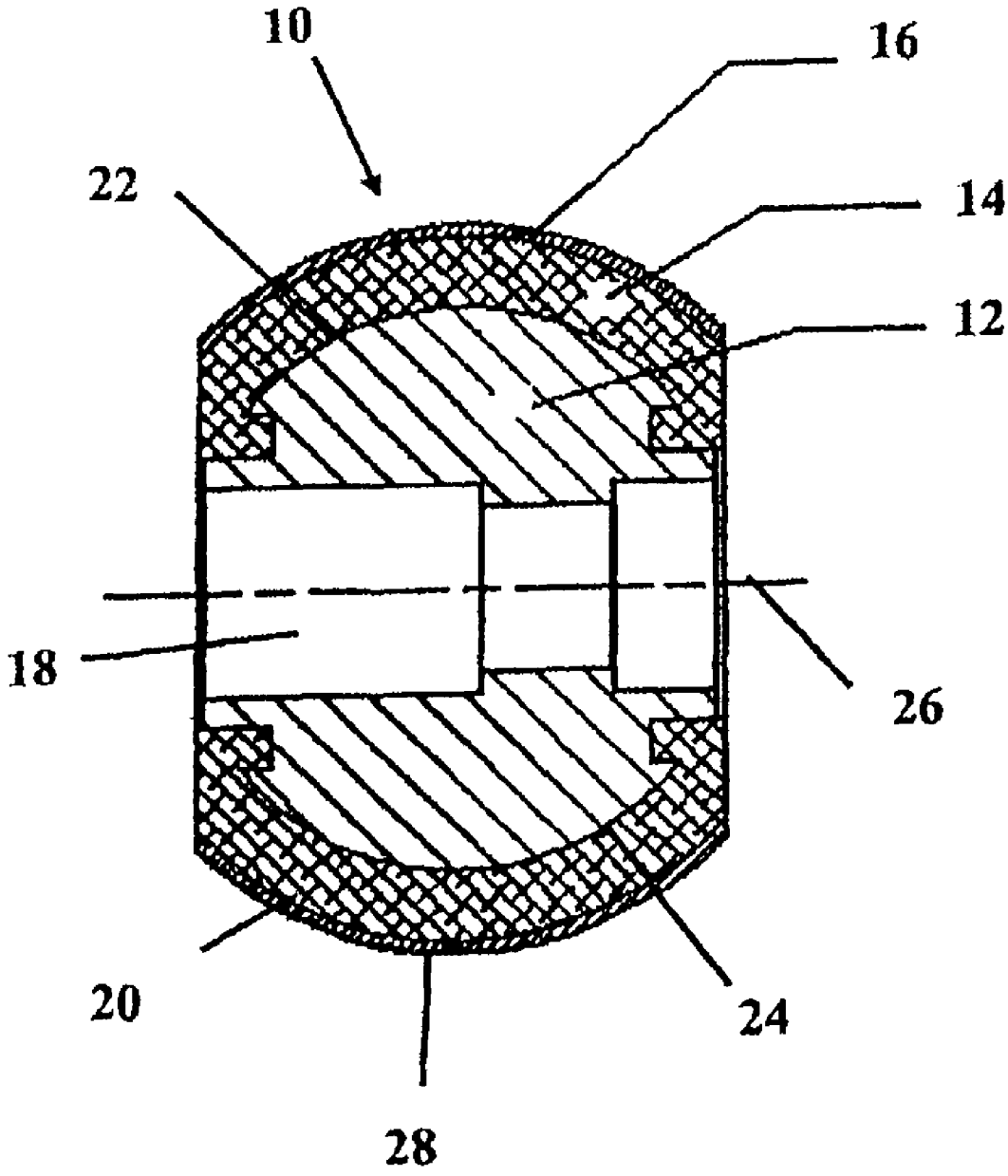
FIG. 1 depicts a cross-sectional view of a certain embodiment of a polishing wheel according to the present invention showing a hub, urethane substrate, and abrasive layer.
Figure 2:
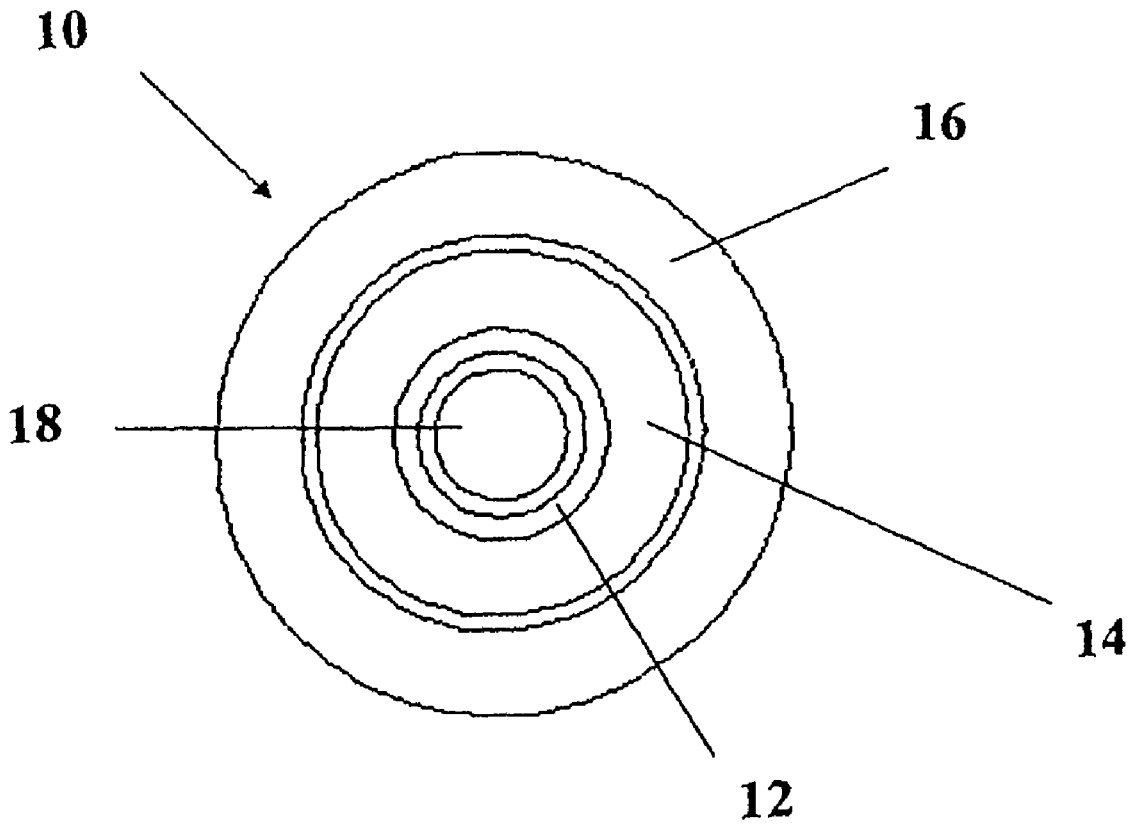
FIG. 2 depicts a top view of the polishing wheel shown in FIG. 1.
Figure 3:
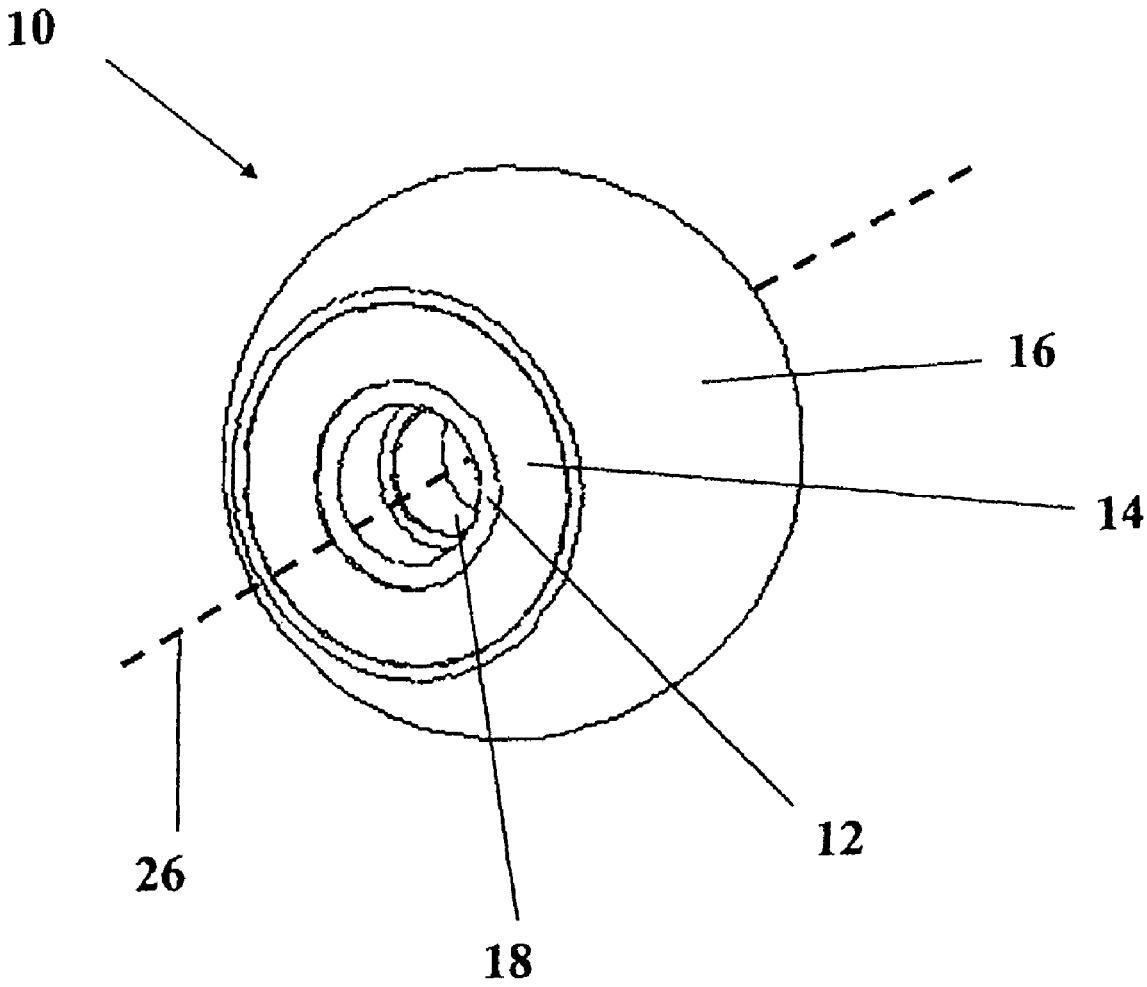
FIG. 3 depicts a perspective view of the polishing wheel shown in FIG. 1.
Figure 4:
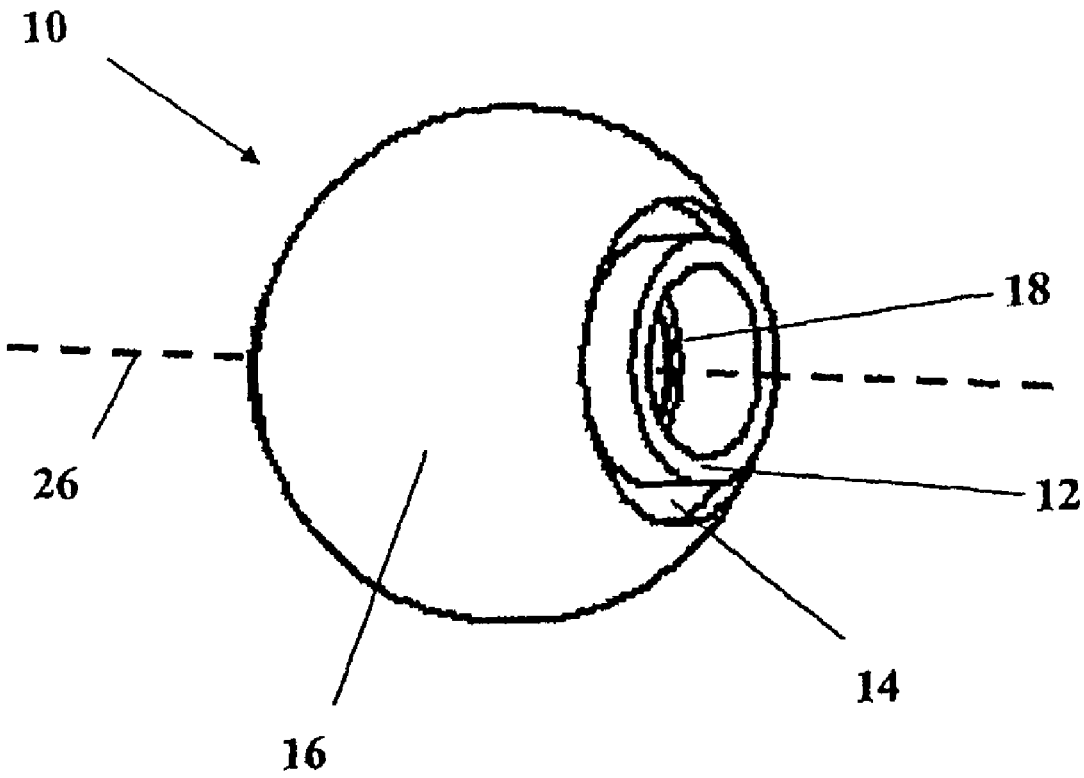
FIG. 4 depicts another embodiment of a polishing wheel wherein the hub extends beyond the abrasive layer.

The present invention provides a polishing wheel having a continuous abrasive layer. More specifically, provided is a polishing wheel having a hub attached to a polyurethane substrate around which an abrasive layer, with a urethane binder and polishing grains, is formed. Because the polishing wheel has a continuous polishing surface without gaps, the likelihood of the abrasive layer splitting or otherwise tearing during polishing operations is reduced. The substrate layer and abrasive layer of the present invention also provide the polishing wheel with particularly good characteristics with respect to vibration, dampening, and rigidity making a gentle abrasive operation possible. In addition, the urethane substrate is less likely to separate from the hub as compared to other substrate materials known in the art, thereby extending the useable life of the polishing wheel. Finally, polishing wheels according to the present invention are also much less susceptible to weakening or being destroyed in the event of a machine malfunction or operator error.

Accordingly, one aspect of the present invention is a polishing wheel for polishing optical lenses comprising a hub having an axial cavity; a polyurethane substrate that has a spherical outer surface and is affixed to and coaxial with the hub; and a continuous abrasive layer comprising a urethane binder and polishing grains that is affixed to the outer surface of the substrate layer.

The abrasive layer of the present invention can be formed by coating the polyurethane substrate with an abrasive composition comprising a urethane binder and polishing grains. Several coating techniques can be used to apply the abrasive composition including dip coating, spraying, or casting. Thus, according to another aspect of the present invention, a method is provided for making a polishing wheel by providing a polyurethane substrate having a spherical outer surface and being affixed to a hub having an axial cavity; providing an abrasive composition comprising a urethane binder and a plurality of polishing grains; and coating the outer surface of the substrate layer with the abrasive composition to form a continuous spherical abrasive layer on the outer surface of the substrate layer.

Yet another aspect of the present invention is a method of polishing an optical lens by contacting the lens with a spherical polishing wheel having a continuous abrasive layer. This method is especially useful for quick and accurate polishing of both sides of a lens or a lens having two or more different curvatures, because a single wheel can polish multiple curvatures thereby eliminating the need to install a different lap for each lens curve.

A polishing wheel 10 in accordance with the present invention is now described with reference to FIGS. 1-4. The polishing wheel 10 includes a hub 12 having an axial cavity 18, a substrate layer 14, and an abrasive layer 16. According to the present invention, the substrate layer 14 has a spherical outer surface 20. As used hereinafter, the term "spherical" refers to having a shape approximating that of a sphere, including, but not limited, to spheroids shapes, and semi-spherical shapes such as spherical frustums. The embodiment shown in FIG. 1 also includes an inner surface 22 at which the substrate layer 14 is affixed to the hub 12. The continuous abrasive layer 16 is formed around the spherical outer surface 20 of the substrate layer 14.

While the shape of the polishing wheel 10 may be varied in accordance with its intended use, the wheel is usually formed with a spherical surface 28 circumscribing the hub axis 26. In addition, the hub, substrate layer, and abrasive layer are preferably coaxial to an axis 26.

In certain preferred embodiments, the hub 12 is made from a metal. Particularly preferred is aluminum because of its machinability and resistance to corrosion. However, other metals are also contemplated by the present invention, for example, steel in particular stainless steel. The hub can also be made from a polymer material like, for example polycarbonate material or resin material. Advantageously the hub has a modulus of elasticity bigger than 1000 MPa. The hub 12 may be produced by forging, casting, machining, or any other suitable manufacturing technique as well known in the art. The hub 12 can be of any size suitable for polishing lenses and such sizes will be readily know to those skilled in the art. For example, in certain preferred embodiments, the hub 12 will have a radius from the axis 26 to the outer surface 24 of from about 5 mm to about 50 mm, more preferably from about 10 mm to about 40 mm, and even more preferably from about 20 mm to about 30 mm.

The hub 12 preferably has a cavity 18 configured to receive a shaft (not shown) in any manner as is well known in the art. For example, the cavity 18 may be threaded for a screw-type connection to the shaft or tapered to produce a friction fit with a complimentary sized shaft. In a particularly preferred embodiment, the cavity 18 is partially threaded and partially smooth, wherein the threaded portion of the shaft is slightly larger than the smooth portion. In this embodiment, the smooth portion of the cavity is sized to receive the shaft while the threaded portion is sized to a tool designed to facilitate removing the wheel from the shaft.

Alternatively, the wheel 10 may be clamped onto the shaft. Such a clamping arrangement may, for example, involve providing a shaft having an annular flange at one end and a threaded connection for receiving a bolt at an opposite end, positioning the shaft through the wheel so that the wheel abuts the flange, and the tightening the nut on the opposite end of the shaft so that the wheel becomes secured to the shaft.

The shaft on which the hub 12 is mounted can be a rotatable, motor-driven shaft. Alternatively, the shaft on which the hub 12 is mounted can be a fixed, non-rotating shaft. In such embodiments, the lens is rotated with respect to the stationary wheel.

Preferably, the hub 12 is constructed with an outer surface 24 that is symmetrical to the axis 26. Such symmetry will help balance the polishing wheel 10 as it rotates and will serve to minimize any gyroscopic vibrations that may be created when the wheel is in contact with the lens.

The substrate layer 14 is made from a polyurethane elastomer that can be affixed to the hub 12 and that has a Shore A hardness from about 15 to about 35. These substrates have been found to provide a polishing wheel with particularly good characteristics with respect to vibration, dampening, and rigidity, which makes a gentle abrasive operation possible. A wide variety of commercially available castable polyester polyurethanes are suitable for use with the present invention, provided that they have a Shore A hardness of from about 15 to about 35. One skilled in the art could readily select a polyurethanes meeting the above criteria. For example, a polyurethane suitable for the present invention is Cast Urethane Polyester Uniroyal Adiprene 15-20 Shore A with Santicizer 160 Plasticizer added to increase the compliance of the substrate.

In certain preferred embodiments, the substrate layer 14 is secured to the hub 12 by casting the polyurethane into an oversized mold around the hub. After the mold is set and the polyurethane cured, the substrate is precision ground to the desired dimensions. The substrate can be ground to a size or shape suitable for polishing lenses and such sizes and shapes will be readily know to those skilled in the art. Preferably, the substrate has a spherical outer surface 20 that circumscribes and is symmetrical with the axis 26. In certain preferred embodiments, the substrate will have a thickness as measured radially from the inner surface 22 to the outer surface 20 from about 3 mm to about 20 mm, more preferably from about 5 to about 15 mm, and even more preferably from about 5 to about 10 mm.

The abrasive layer 16 functions as the polishing surface of the polishing wheel 10, and during the polishing process, it is in direct contact with the lens surface. The abrasive layer contains fine abrasive particles (polishing grains) that when moved across the surface of the lens, can remove a thin layer from the surface of the lens thereby reducing the lens' surface roughness. The abrasive layer is typically curved in order to follow the curved contour of the lens surface.

The abrasive layer 16 is a cured urethane binder in which polishing grains are embedded. The abrasive layer is formed by coating the substrate layer 14 with an abrasive composition comprising an uncured liquid urethane binder and a plurality of polishing grains suspended therein. Any applicable coating technique known in the art may be used to apply the abrasive composition to the substrate including dip coating, casting, or spraying.

After the abrasive composition is applied, the urethane is cured to form a hard shell around the substrate, wherein a portion of the polishing grains are exposed. This shell is then ground to a size and shape suitable for polishing lenses and such sizes and shapes will be readily known to those skilled in the art. Preferably, the abrasive layer is shaped to create a spherical work-engaging surface with a thickness measured radially from the inner surface to the outer surface of about 0.1 mm to about 2.5 mm, preferably from 0.2 to 0.8 mm. However, the thickness of the abrasive layer can be more or less than this, depending on the particular polishing wheel and polishing application. Preferably, the thickness of the abrasive layer is uniform.

The urethane of the abrasive layer has a Shore A hardness from about 66 to about 96. In order to create a more resilient abrasive surface, the urethane of this layer is harder than the urethane of the substrate. A wide variety of commercially available urethanes are suitable for use with the present invention, provided that they have a Shore A hardness of from about 66 to about 96. One skilled in the art could readily select a polyurethanes meeting the above criteria.

The polishing grains used in the practice of this invention are available commercially in standard sizes. Preferably, grains are discretely sized from about 0.5 μm to 20.0 μm, with from about 0.5 μm to about 1.5 μm being more preferred. In certain preferred embodiments, the polishing grains are all of one approximate size. The grains are abrasive materials such as zirconium oxide, diamonds, cesium oxide, cerium oxide, silicon carbide, aluminum oxide, boron carbide, cubic boric nitrite, emery, garnet, and the like, but are preferably zirconium oxide or cerium oxide. The grains can be randomly distributed in the abrasive layer or can form a matrix. In either a random distribution or a matrix, the grains are preferably evenly distributed throughout the abrasive layer. The amount of grains used will depend upon the material from which the surface to be polished is composed.

According to another aspect of the present invention, a novel method for making a polishing wheel is provided. This method has the steps of (a) providing a polyurethane substrate having a spherical outer surface and being affixed to a hub; (b) providing an abrasive composition comprising a liquid urethane binder and a plurality of polishing grains; (c) coating the outer surface of the substrate with the abrasive composition to form a continuous spherical abrasive layer on the outer surface of the substrate; and (d) curing the urethane binder to form a hard outer surface.

The coating is applied to the outer surface of the substrate by any of a number of coating processes known in the art, including, but not limited to, dip coating, spraying, and casting.

According to yet another aspect of the present invention, an improved method of polishing an optical lens is provided. This method includes the steps of (a) providing an optical lens blank having a first side with the first side having surface roughness; (b) providing a spherical polishing wheel having a continuous urethane abrasive layer; (c) providing a rotating element wherein the element is either the wheel of step (b) or the lens blank of step (a), or both; and (d) contacting the first side of the lens with the polishing wheel to reduce the surface roughness. The lens to be polished is preferably glass or plastic.

The first side of the lens typically has an area having an approximate parabolic or spherical curvature that was generated by a grinding process. According to certain preferred embodiments, the method of polishing a lens further comprises the step of contacting this area with the polishing wheel to remove a portion of the lens so as to produce a truer parabolic or spherical curvature. This step is typically performed in unison with step (d).

In certain embodiments, the lens to be polished has two or more different curvatures, such as a bifocal lens, wherein a portion of the lens has a first curvature for correcting hyperopia (farsightedness), while a separate portion of the lens has a different curvature for viewing object at close range. Other examples of lenses with two or more different curvatures include those for correcting astigmatism. Thus, according to certain embodiments of this aspect of the present invention, the first side of the lens comprises a first curvature having a first diopter $D_1$ and a second curvature having a second diopter $D_2$, wherein $D_1 \neq D_2$.

The lens polishing method of the present invention can be adapted to processes wherein the lens rotates with respect to a stationary polishing wheel, or the polishing wheel rotates with respect to a stationary lens, or the polishing wheel and lens rotate with respect to each other, but in opposite directions.

Advanced polishing machines equipped with a polishing wheel according to the present invention are particularly well suited for polishing lenses having complex angles and for polishing two sides of a lens with a single machine. For example, in a preferred method of polishing a lens, the polishing wheel is mounted to a rotating shaft or spindle of an advanced polishing machine which can control, preferably by computer numerical control (CNC), the rotational speed of the wheel and the wheel's movement along a first horizontal axis (the "X-axis") having a left/right orientation and a second horizontal axis (the "Y-axis") having a front/rear orientation, each axis orientation being relative to the shaft or spindle. In addition, the movement of the spindle upon which the wheel is controlled vertically along a "Z-axis" and rotationally about a "C-axis" the orientation of each axis also being relative to the shaft or spindle. These advanced polishing machines typically utilizing a positional feed-back system to control the movement of the wheel. Such advanced polishing machine control schemes are readily known by those skilled in the art.

EXAMPLES

The present invention is described in more detail by the following examples which are not intended to limit the scope of this invention in any way.

Comparative Example 1

The process for measuring the material removal rate of the polishing process requires generating a cut surface with a large chamfer on the outside edge. This chamfer will not be touched during the polishing process and it provides a fixed reference for measurement.

The lens is blocked and the surface is cut. The surface of the blocked lens is then measured on a profilometer. A profilometer is typically used to measure surface roughness but in this case it can be used to measure the difference between the cut surface before and after polishing. The lens surface is then polished with a conventional polishing wheel for 400 seconds and measured on the profilometer again. The polished area has had some material removed from it and is lower relative to the chamfered area which is not touched during the polishing process. The measurement traces taken before and after polishing are aligned and the differences between them are the resultant rate of material removal with the chamfered area used as a common reference point.

Figure 5:
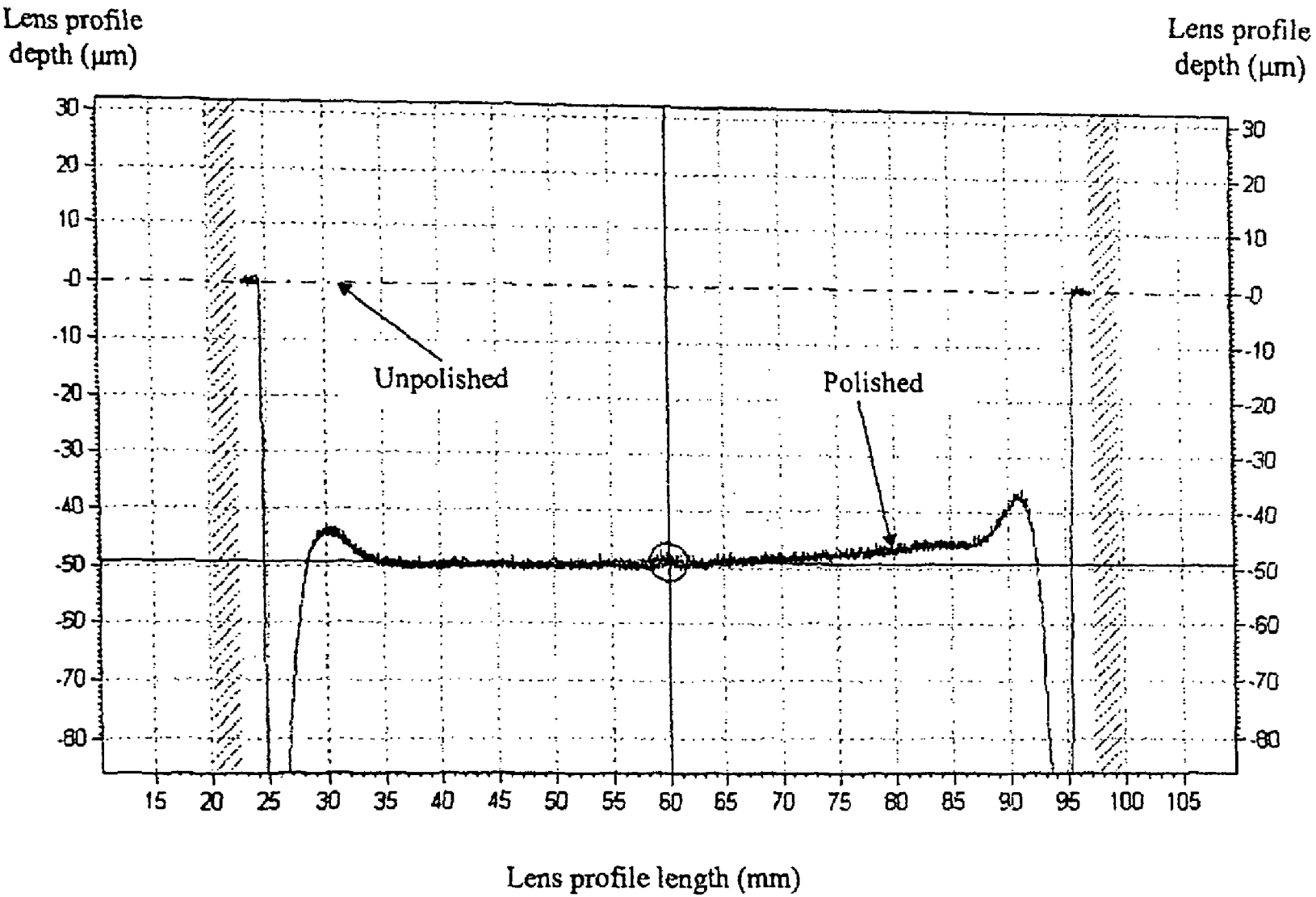
FIG. 5 is a chart depicting the removal of material from the surface of a lens during a polishing operation using a conventional polishing wheel.

As shown in FIG. 5, approximately 45 microns of material is removed from the lens surface during the polishing operation.

Example 2

The process for measuring the material removal rate of the polishing process requires generating a cut surface with a large chamfer on the outside edge. This chamfer will not be touched during the polishing process and it provides a fixed reference for measurement.

The lens is blocked and the surface is cut. The surface of the blocked lens is then measured on a profilometer. A profilometer is typically used to measure surface roughness but in this case it can be used to measure the difference between the cut surface before and after polishing. The lens surface is then polished with a polishing wheel according to the present invention for 400 seconds and measured on the profilometer again. The polished area has had some material removed from it and is lower relative to the chamfered area which is not touched during the polishing process. The measurement traces taken before and after polishing are aligned and the differences between them are the resultant rate of material removal with the chamfered area used as a common reference point.

Figure 6:
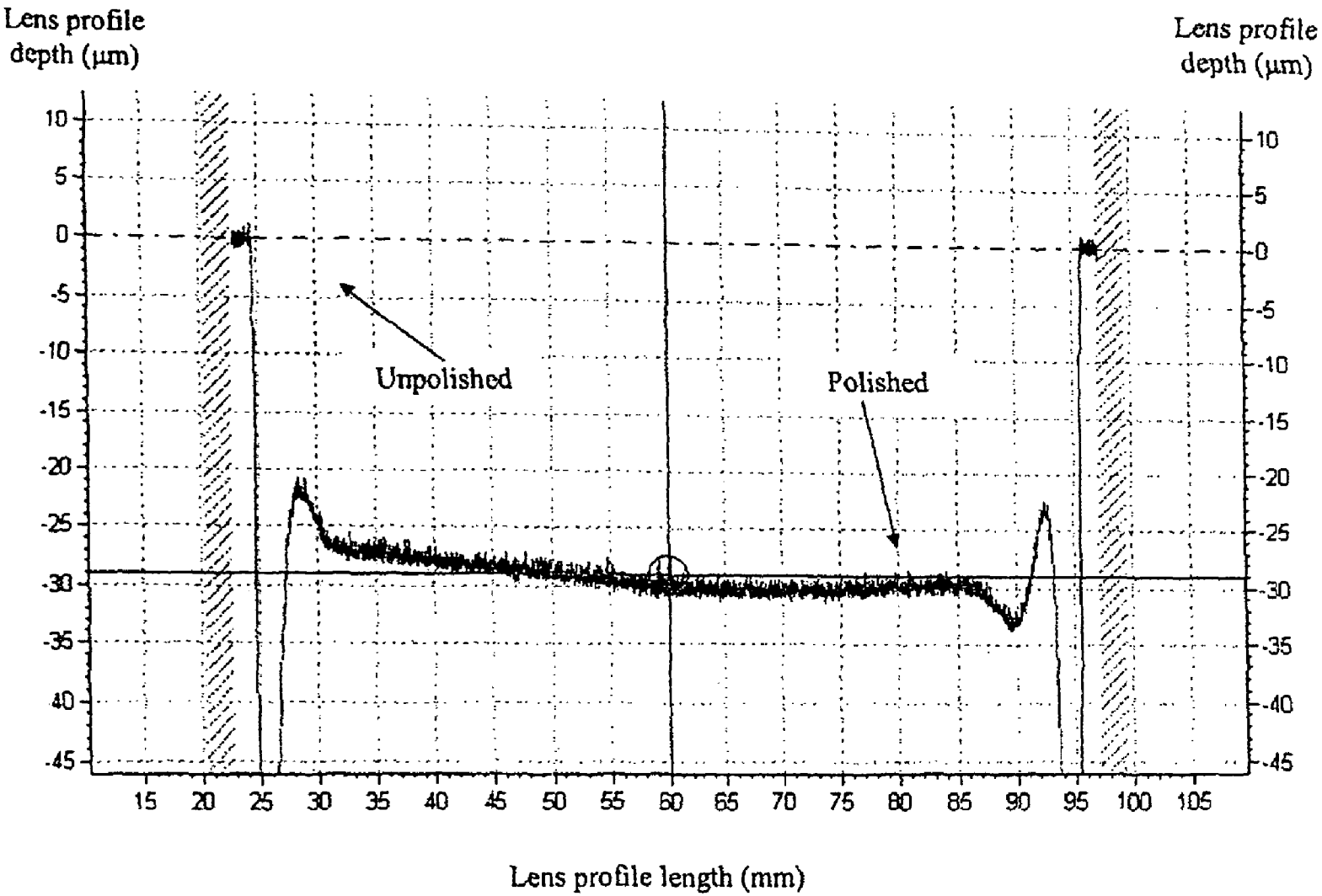
FIG. 6 is a chart depicting the removal of material from the surface of a lens during a polishing operation using a polishing wheel according to the present invention.

As shown in FIG. 6, approximately 30 microns of material is removed from the lens surface during the polishing operation.

The detailed description hereinbefore with reference to the drawings illustrates a polishing wheel 10 arranged to polish an article. The polishing wheel comprises:

- a hub 12 provided with an axial cavity 18 coaxial with an axis 26;
- a substrate layer 14 being made of an elastomer material affixed to the hub 12 and coaxial with the axis 26, the substrate layer 14 having an outer surface 20, the outer surface 20 having a substantially symmetrical shape with respect to the axis 26; and
- a continuous cover layer 16 affixed to the outer surface 20 and coaxial with the axis 26, the continuous cover layer 16 being made of an elastomer material covering substantially entirely the outer surface 20.

The remarks made hereinbefore demonstrate that the detailed description with reference to the drawings, illustrate rather than limit the invention. There are numerous alternatives, which fall within the scope of the appended claims. Any reference sign in a claim should not be construed as limiting the claim. The word "comprising" does not exclude the presence of other elements or steps than those listed in a claim. The word "a" or "an" preceding an element or step doest not exclude the presence of a plurality of such elements or steps.

The invention claimed is:

1. A polishing wheel arranged to polish an article, the polishing wheel comprising:

- a hub having a modulus of elasticity that is bigger than 1000 MPa and that is provided with an axial cavity coaxial with an axis;
- a substrate layer being made of an elastomer material having a Shore A hardness from 15 to 3, the substrate layer affixed to the hub and coaxial with the axis, the substrate layer having an outer surface, the outer surface having a substantially symmetrical shape with respect to the axis; and
- a continuous cover layer affixed to the outer surface and coaxial with the axis, the continuous cover layer being made of urethane binder having Shore A hardness from 66 to 96 and covering substantially entirely the outer surface.

2. The polishing wheel according to claim 1, wherein the continuous cover layer comprises polishing grains.

3. The polishing wheel according to claim 1, wherein the outer surface is spherical.

4. The polishing wheel according to claim 1, wherein the substrate layer is made from a polyurethane material.

5. The polishing wheel of claim 1, wherein the hub has a spherical outer surface approximately symmetrical to the axial cavity.

6. The polishing wheel of claim 1, wherein the continuous cover layer has a substantially uniform thickness.

7. The polishing wheel of claim 2, wherein the polishing grains are abrasives selected from the group consisting of diamonds, cesium oxide, silicon carbide, aluminum oxide, boron carbide, cubic boric nitrite, emery, zirconium oxide , cerium oxide, and garnet.

8. A method of manufacturing a polishing wheel arranged to polish an article, the polishing wheel comprising a hub having a modulus of elasticity that is bigger than 1000 MPa and that is provided with an axial cavity coaxial with an axis, a substrate layer being made of an elastomer material having a Shore A hardness from 15 to 3 the subs rate layer affixed to the hub and coaxial with the axis, the substrate layer having an outer surface, the outer surface having a substantially symmetrical shape with respect to the axis, wherein the method comprises a covering step, in which the outer surface of the substrate layer is covered with urethane binder having a Shore A harness from 66 to 96 so as to obtain a continuous cover layer covering substantially entirely the outer surface.

9. The method according claim 8, wherein the covering step is done by coating technique.

10. The method according to claim 8, wherein the covering step is done by molding technique.

11. The method according to claim 9, wherein the covering step is followed by a curing step, in which the elastomer material is cured.

12. The method according to claim 8, wherein the substrate layer is affixed to the hub by using a molding technique.

13. The method according to claim 12, wherein the outer surface of the substrate layer is machined so to obtain a substantially symmetrical shape with respect to the axis.

14. A method of polishing an article, the method comprising the steps of:

(a) providing an article comprising a first side having a surface roughness,;

(b) providing a polishing wheel according to claim 1;

(c) rotating, in which the article and the polishing wheel are rotating with respect to each other by using a rotating element.

(d) contacting the first side of the article with the polishing wheel to reduce the surface roughness.

15. The method according to claim 14 wherein an area of the first side has an approximate parabolic or spherical curvature and further comprising the step of:

(e) contacting the area of the first side with the polishing wheel to remove a portion of the article to produce a truer parabolic or spherical curvature.

16. The method according to claim 14 wherein the article is a lens, and wherein the first side comprises a first curvature having a first diopter $D_1$ and a second curvature having a second diopter $D_2$, wherein $D_1 \neq D_2$.

17. The method according to claim 14 wherein the contacting step comprises controlling the polishing wheel along an X-axis, Y-axis, Z-axis, and C-axis.

18. The method according to claim 14 wherein the polishing wheel is controlled by a computer numerical controlled device.

19. The method according to claim 14 wherein the article is a lens made from glass or plastic.

20. A computer program product for a data processing device, the computer program product comprising a set of instructions which, when loaded into the data processing device, causes the device to perform at least one of the steps of the methods as claimed in claim 14.

* * * * *